United States Patent [19]

Berry

[11] 3,977,198

[45] Aug. 31, 1976

[54] MULTIPLE BOILER STEAM GENERATION SYSTEM

[76] Inventor: Clyde F. Berry, R.F.D. No. 7, Box 169-C, Manchester, N.H. 03104

[22] Filed: Oct. 16, 1975

[21] Appl. No.: 622,812

Related U.S. Application Data

[63] Continuation-in-part of Ser. No. 559,164, March 17, 1975, abandoned.

[52] U.S. Cl. ..... 60/676; 122/37; 219/271; 219/275

[51] Int. Cl.[2] ..... F22B 33/00; F01K 11/00

[58] Field of Search ..... 290/2; 122/37; 60/676; 219/271, 272, 273, 275, 341

[56] References Cited

UNITED STATES PATENTS

| | | | |
|---|---|---|---|
| 1,185,246 | 5/1916 | Santry | 60/648 X |
| 3,007,457 | 11/1961 | Ospelt | 122/37 |

FOREIGN PATENTS OR APPLICATIONS

| | | | |
|---|---|---|---|
| 333,102 | 8/1930 | United Kingdom | 60/676 |

*Primary Examiner*—Allen M. Ostrager
*Attorney, Agent, or Firm*—C. Yardley Chittick

[57] ABSTRACT

Steam generation means utilizing first and second boilers, the first of which is a high pressure boiler located within or in very intimate heat transfer contact with the second boiler. The steam generated in the high pressure boiler is used to drive continuously or intermittently, a turbine and an associated electrical generator whose output activates electrical resistance units located in the boilers. These heating units supplement an external heat source to maintain steam pressure in the high pressure boiler. The exhaust steam from the turbine at reduced pressure is used to supply heat in any closed steam consuming device such as a space heating system. The condensate is returned to the second boiler which acts as a preheater for water to be pumped from said second boiler to said first boiler as needed.

9 Claims, 1 Drawing Figure

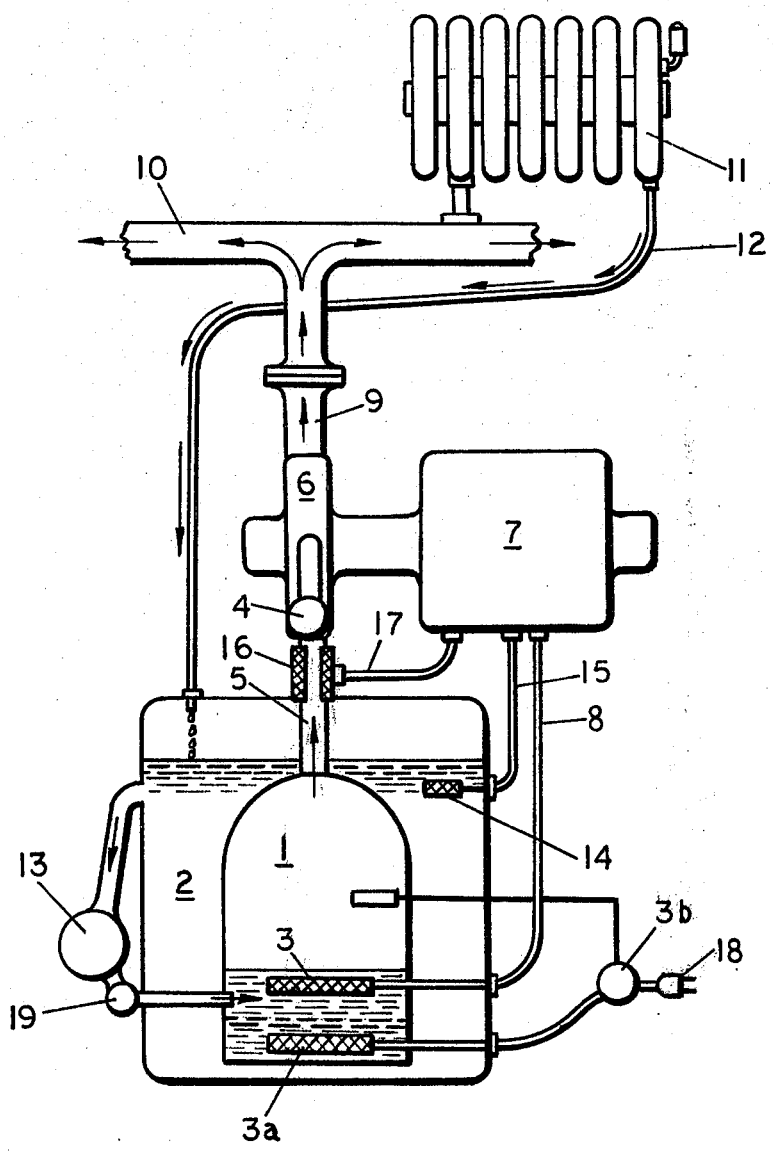
10
11
12
9
6
7
4
17
16
5
15
8
14
13
2
1
3b
3
18
19
3a

MULTIPLE BOILER STEAM GENERATION SYSTEM

RELATED APPLICATION

This application is a continuation-in-part of the application of Clyde F. Berry, Ser. No. 559,164 filed Mar. 17, 1975.

FIELD OF THE INVENTION

The invention relates to a method and means for steam generation and the utilization thereof. Steam is ordinarily used as means for heating or for driving some prime mover such as steam turbine or reciprocating engine.

In the case of steam heating, the system is usually of the closed circuit type in which the condensate is returned to the boiler for re-use.

In the case of steam driven engines, the exhaust steam leaving the prime mover may be discharged to the atmosphere or, in a closed system, after giving up its heat to the steam utilization means, the condensate may be returned to the boiler.

In the production of steam for any of the above uses, the heat source is customarily coal, oil, gas or other combustible fuel. In the present invention the heat source is provided preferably by electric power exclusively, part of which is generated in a self-contained steam electric system. The extra heat needed in excess of the self-generated electricity, to maintain steam pressure may be provided preferably by an outside source of electricity or by burning any suitable available fuel.

SUMMARY OF THE INVENTION

The present invention contemplates the use of an efficient two boiler system, in which a small high pressure boiler is located within a large low pressure boiler. The sources of heat for both boilers are (1) electric heating elements, the power for which is supplied by a generator turned by a prime mover driven by steam from the high pressure boilers and (2) additional externally supplied heat to the extent needed to maintain steam pressure. The exhaust steam from the turbine that drives the generator may be used for space heating or actuation of any other steam utilization device.

From the foregoing it will be understood that an important object of the invention is to improve the efficiency of a method of producing steam to be used in a closed system that includes a steam consuming device while at the same time minimizing atmospheric pollution.

Where fuel is burned to supply the outside additional heat, the heat so produced may be delivered to the water in the high pressure boiler or to both boilers if desired by any convenient flues or piping all suitably insulated to minimize loss.

These and other objects of the invention will become more apparent as the description proceeds with the aid of the accompanying drawing in which the single FIGURE shows a two boiler system adapted to carry out an economical process of producing steam to be used in a steam consuming device.

DESCRIPTION OF A PREFERRED EMBODIMENT

Referring to the drawing there is shown a steam boiler 1 located preferably completely within the confines of a second larger boiler 2. By having one boiler within the other, and with the outer boiler thoroughly insulated, heat loss may be held to a minimum. The water in boiler 1 is heated in part by one or more electric heating elements 3 located so as to be in the most effective place to transmit heat to the boiler water.

The balance of the required heat necessary to maintain steam at the desired pressure may be provided by any conventional external source. In the drawing an electrical heating element 3*a* may be used. The unit 3*a*, however, is to be considered as representing any source of outside heat. Heat source 3*a* whether electrical or otherwise is temperature or pressure controlled by control 3*b* so that outside heat will be supplied whenever additional heat is needed to maintain or increase steam pressure.

Boiler 1, being part of a closed system, requires only a small quantity of water which may quickly be brought to boiling by elements 3 and 3*a*. A pipe 5 leads from boiler 1 to a turbine 6. Flow of steam through pipe 5 is controlled by a pressure actuated valve 4 which is set to open when the pressure in the boiler falls below a predetermined pressure $x$ and to close when the pressure rises above another higher predetermined pressure $y$.

Exhaust steam from turbine 6 passes through pipe 9 to a steam header 10 to which are connected one or more steam consuming devices such as the steam heat radiator shown at 11. Radiator condensate drains by gravity through pipe 12 back to boiler 2.

Turbine 6 is geared to a generator 7. With the turbine operating whenever the valve 4 is open, the generator 7 will supply current through wire 8 to heating element 3. Element 3 assisted by outside heat source 3*a* will cause steam to be generated faster than it is being used by turbine 6. Thus the steam pressure in boiler 2 will rise and on reaching pressure $y$, valve 4 will close and the turbine 6 and generator 7 will shut down to discontinue current to heating element 3. When the steam pressure in boiler 1 drops to $x$, which is still adequate to operate the turbine generator set, valve 4 opens and the generator 7 driven by turbine 6 now reheats element 3 aided by heat source 3*a* if called for to create more steam, raising the steam pressure again to $y$ at which point valve 4 again closes to shut down the turbine-generator set. This cycle is repeated indefinitely.

Alternatively turbine 6 and generator 7 may run continuously with valve 4 being open at all times. Steam pressure in boiler 1 in such case is controlled by periodic operation of element 3*a* through operation of pressure or temperature activated control 3*b*. Intermittent operation of element 3*a* will hold the steam pressure between preset limits.

Boiler 2 contains more water than boiler 1. Preferably boiler 1 as shown in the drawing will be submerged in the water of boiler 2. A second electric heating element 14 is in heat transfer contact with the water of boiler 2. Element 14, like element 3, is supplied with heating current from generator 7 by wire 15 whenever the turbine generator set is in operation. The heat of element 14 is sufficient to maintain the water in boiler 2 at a temperature close to 212°F. The condensate from the radiators 11 serves to substantially replace the water that is periodically being pumped by feed pump 13 from boiler 2 into high pressure boiler 1. Boiler check valve 19 prevents reverse flow through pump 13. Any loss of water in boiler 2 may be replaced in conventional manner by an automatic or manual feed supply valve (not shown).

An additional heating element 16 supplied with current from generator 7 may be attached to pipe 5 to produce super heated steam flowing to turbine 5 thereby to increase efficiency.

From the foregoing explanation, it will be seen that the exhaust steam from turbine 6 used in a steam consuming device such as a space heater can be generated very economically. The initial start up is accomplished by utilizing any outside source of heat as represented by unit 3*a*. If outside electric power is used, it may be delivered by connection 18 to unit 3*a*. This current is supplied only long enough to get up steam pressure sufficient to put the turbine-generator set into operation to provide the needed current to heat element 3. The control 3*b* will then discontinue the outside heat source until additional outside heat is again required to maintain steam pressure.

In the foregoing disclosure, the generator has been driven in the preferred form by a turbine 6. It will be understood however, that any other prime mover such as for example, a reciprocating steam engine, could be substituted for the turbine 6.

In the claims, therefore, it will be appreciated that when the term "turbine" is used, any other steam driven prime mover whose exhaust steam may be piped to supply heat to a steam consuming device, is to be considered the equivalent thereof.

The above disclosure will suggest to others skilled in the art modifications which are within the scope of the invention as defined by the appended claims.

I claim:

1. In combination, a first boiler within a second larger boiler, a first electrically actuated heating element in heat transfer engagement with the water in said first boiler, an outside source of heat for the water in said first boiler, a turbine adapted to be driven by steam from said first boiler, an electric generator driven by said turbine, said generator operatively connected to said first heating element whereby when said generator is being driven by said turbine said generator will supply current to said first heating element to provide some of the heat which together with the outside heat source will form steam in said first boiler faster than steam is being used to drive said turbine, means for controlling the flow of steam to said turbine, an exhaust steam pipe from said turbine leading to a closed system steam consuming device, means for returning the condensate from said device to said second boiler, and a second electrically actuated heating element in said second boiler capable of maintaining the water temperature therein at a predetermined degree.

2. The combination set forth in claim 1, said second heating element also operatively connected to said electric generator.

3. The combination set forth in claim 1, said means for controlling the flow of steam to said first turbine comprising a pressure controlled valve including means to close said valve when rising steam pressure in said first boiler reaches a predetermined high pressure and means to open said valve when falling steam pressure in said first boiler reaches a predetermined low pressure that is lower than said high pressure.

4. The combination set forth in claim 1, the said means for controlling the flow of steam to said turbine comprising means for controlling the on and off periods of said outside source of heat for said boiler.

5. The combination set forth in claim 1, said outside source of heat comprising an electric heating element adequate by itself to create steam in said first boiler at sufficient pressure to place said turbine and generator in operation.

6. The combination set forth in claim 1, said steam consuming device being one or more heat distributing radiators.

7. The combination set forth in claim 1, and a boiler feed pump having its inlet connected to said second boiler and its outlet leading into said first boiler.

8. A method of generating steam for utilization in a closed steam consuming device, said method comprising the steps of continuously generating steam in a boiler by using two separate heating means, feeding the steam so generated to a turbine, driving an electric generator by said turbine, utilizing at least some of the electric output of said generator to supply one of said heating means, to assist in steam generation in said boiler, utilizing an outside source to supply said other heating means, delivering the exhaust steam from said turbine to said steam consuming device where the steam after heating said steam consuming device will condense, returning the steam condensate from said steam consuming device to a closed water container in which said boiler is located, pumping water from said container to said boiler in sufficient quantity to maintain the water level in said boiler, and controlling the operation of said heating means thereby to maintain steam pressure in said boiler between predetermined limits.

9. The method set forth in claim 8, and heating the water in said container through the use of some of the output of said electric generator to maintain a temperature in the vicinity of 212°F.

* * * * *